US006883435B1

(12) United States Patent
Schildknecht et al.

(10) Patent No.: US 6,883,435 B1
(45) Date of Patent: Apr. 26, 2005

(54) PENETRATOR

(75) Inventors: Manfred Schildknecht, Eckental (DE); Karl Rudolf, Schrobenhausen (DE)

(73) Assignee: Diehl GmbH & Co., Nürnberg (DE)

( * ) Notice: Subject to any disclaimer, the term of this patent is extended or adjusted under 35 U.S.C. 154(b) by 1826 days.

(21) Appl. No.: 08/769,892

(22) Filed: Jan. 2, 1997

(30) Foreign Application Priority Data

Jan. 4, 1996 (DE) ..... 196 00 167

(51) Int. Cl.[7] ..... F42B 12/20
(52) U.S. Cl. ..... 102/518; 102/473; 102/491
(58) Field of Search ..... 102/382, 389, 102/473, 491–493, 514, 516–519

(56) References Cited

U.S. PATENT DOCUMENTS

| | | | | | |
|---|---|---|---|---|---|
| 713,412 | A | * | 11/1902 | Erdman | 102/473 |
| 874,282 | A | * | 12/1907 | Aneson | 102/473 |
| 1,069,237 | A | * | 8/1913 | Douglas | 102/519 |
| 4,398,467 | A | * | 8/1983 | Leigh | 102/491 |
| 4,603,801 | A | * | 8/1986 | Wan et al. | 228/194 |
| 4,662,280 | A | * | 5/1987 | Becker et al. | 102/517 |
| 5,020,439 | A | * | 6/1991 | Winter et al. | 102/518 |
| 5,131,329 | A | * | 7/1992 | Lips et al. | 102/493 |
| 5,133,259 | A | * | 7/1992 | Schluckebier | 102/473 |
| 5,148,750 | A | * | 9/1992 | Becker et al. | 102/473 |
| H1235 | H | | 10/1993 | Canaday | |

FOREIGN PATENT DOCUMENTS

| | | | | |
|---|---|---|---|---|
| DE | PS 114 188 | | 3/1899 | |
| DE | 40 07 196 | A1 | 9/1991 | |
| DE | 31 51 525 | C1 | 10/1991 | |
| DE | 4033754 | * | 4/1992 | 102/473 |

* cited by examiner

*Primary Examiner*—Stephen M. Johnson
(74) *Attorney, Agent, or Firm*—Scully, Scott, Murphy & Presser

(57) ABSTRACT

A penetrator, including a penetrator housing in which there is arranged an explosive charge and an ignition system for the triggering of the explosive charge. The penetrator housing consists of a composite of a steel outer housing and a heavy-metal inner component, whereby the heavy-metal inner component, at predetermined external dimensions of the penetrator, is provided for the reduction of the mass of the steel outer housing and thus leads to an increase in the volume of the explosive charge and correspondingly to an increase in the mass of the explosive charge.

9 Claims, 1 Drawing Sheet

PENETRATOR

BACKGROUND OF THE INVENTION

1. Field of the Invention

The present invention relates to a penetrator, including a penetrator housing in which there is arranged an explosive charge and an ignition system for the triggering of the explosive charge.

2. Discussion of the Prior Art

A penetrator of that type is known, for example, from the disclosure of German DE 31 51 525 C1. In this known penetrator, the penetrator housing consists of a heavy-metal sinter alloy including a high proportion of, preferably, tungsten and/or at least one other component possessing a high density. The utilization of such a heavy-metal sinter alloy as the material for the entire penetrator housing has, accordingly, an adverse effect on the overall cost of the penetrator. Due to this reason, there is ordinarily employed a suitable steel for the penetrator housing.

SUMMARY OF THE INVENTION

Accordingly, it is an object of the present invention to provide a penetrator which can be manufactured relatively inexpensively or comparatively economical, and whereby it is possible to attain a significant increase in the quantity of the explosive charge.

The foregoing object is attained in connection with a penetrator of the above mentioned type in that the penetrator housing consists of a composite of a steel outer housing and a heavy-metal inner component, whereby the heavy-metal inner component, at predetermined external dimensions of the penetrator, is provided for the reduction of the mass of the steel outer housing and thus leads to an increase in the volume of the explosive charge and correspondingly to an increase in the mass of the explosive charge.

Inasmuch as in the inventive penetrator the penetrator housing consists of a composite structure constituted of a steel outer housing and a heavy-metal inner component, whereby the heavy-metal inner component, at specified external dimensions of the penetrator, serves for obtaining a reduction in the mass of the steel outer housing and, resultingly, for an increase in the volume of the explosive charge and correspondingly for an increase in the quantity of the explosive charge. Consequently, there is inventively obtained, in an advantageous manner, a bunker-rupturing penetrator, in which as a further advantage, there is no reduction in the penetrating capability thereof through concrete.

The inventive penetrator is expediently dimensioned in such a manner that, not only do the external dimensions precisely correspond with the external dimensions of usual penetrators, but that in addition thereto, also the volume and the total mass precisely corresponds with the volume and the total mass of usual penetrators. Through the inventive construction there is thus obtained a penetrator which is optimized with regard to its explosive charge or with regard to payload. This is inventively achieved in that by means of the heavy-metal inner component, there is saved the mass corresponding to the heavy-metal inner component through use of the steel outer housing. The herewith achieved increase in the volume of the payload stands available for a corresponding increase in the explosive charge. At a suitable dimensioning of the penetrator, the volume of its payload can be increased by a magnitude of 50% or more.

Outstanding penetrating properties or capabilities up to impact angles in the magnitude of about 300 or higher are obtained when, in the inventive penetrator, the heavy-metal inner component possesses a solid tip portion which is correlated to the inner contour of the steel outer housing, to which there unitarily convects towards the rear a thin-walled sleeve portion. The solid tip portion of the heavy-metal inner component preferably possesses a concave rear surface which continuously forms a transition into the rearwardly-located sleeve portion. Thereby, the sleeve portion of the heavy-metal inner component, in comparison with the overall length of the steel outer housing of the penetrator, can possess a short longitudinal axial extent, or can extend along the entire length of the steel outer housing of the penetrator.

The steel outer housing of the inventive penetrator is preferably constituted of a high strength, hard, ductile steel alloy. A penetrator of that type evidences the advantage that the steel outer housing is in a position to absorb the shear and bending loads which are encountered during penetration, especially at an angular impact. With regard to the mentioned steel alloy this can pertain, for example, to 30 Cr Ni Mo 8; to X 41 Cr Mo V 51; to 40 Ni Cr Mo V 15 7; to X 120 Mn 12, and to X 2 Ni Co Mo Ti 18 12 5, or the like. The heavy-metal inner component can be constituted of an alloy of a heavy-metal and tungsten or of pure tungsten.

In the inventive penetrator it is of importance to afford that the connection between the steel outer housing and the heavy-metal inner component will not lead to any impermissibly high notch or impact stresses. This can be achieved in that, for example, the steel outer housing and the heavy-metal inner can be connected with each other through a shrink-fitting. In the same manner it is possible that, for example, the steel outer housing and the heavy-metal inner component, can be interconnected by means of a copper matrix through forging of the components. Another possibility consists of in that the steel outer housing and the heavy-metal inner part are interconnected by means of a metallic adhesion layer through a diffusion-controlled temperature/pressure process. In this diffusion-controlled temperature/pressure process, this relates to preferably a hot-isostatic pressing process. The diffusion temperature is essentially dependent upon the composition of the metallic adhesion layer. The latter can be constituted of tantalum, cobalt, cobalt-iron, nickel, nickel-iron, vanadium. The adhesion connecting layer can be galvanically applied onto the components which are to be interconnected. In the same manner it is possible to introduce the metallic adhesion layer in the form of a foil between the components which are to be interconnected.

The connection between the steel outer housing and the heavy-metal inner component can be implemented for the inventive penetrative; for example, through electron/laser beam welding, through friction welding, or through spray compacting.

BRIEF DESCRIPTION OF THE DRAWINGS

Further details, features, and advantages of the invention can now be ascertained from the following detailed description of two exemplary embodiments, illustrated the accompanying drawings in half-section, showing the inventive penetrator on a reduced scale; and in which.

BRIEF DESCRIPTION OF PREFERRED EMBODIMENTS

Figure 1:
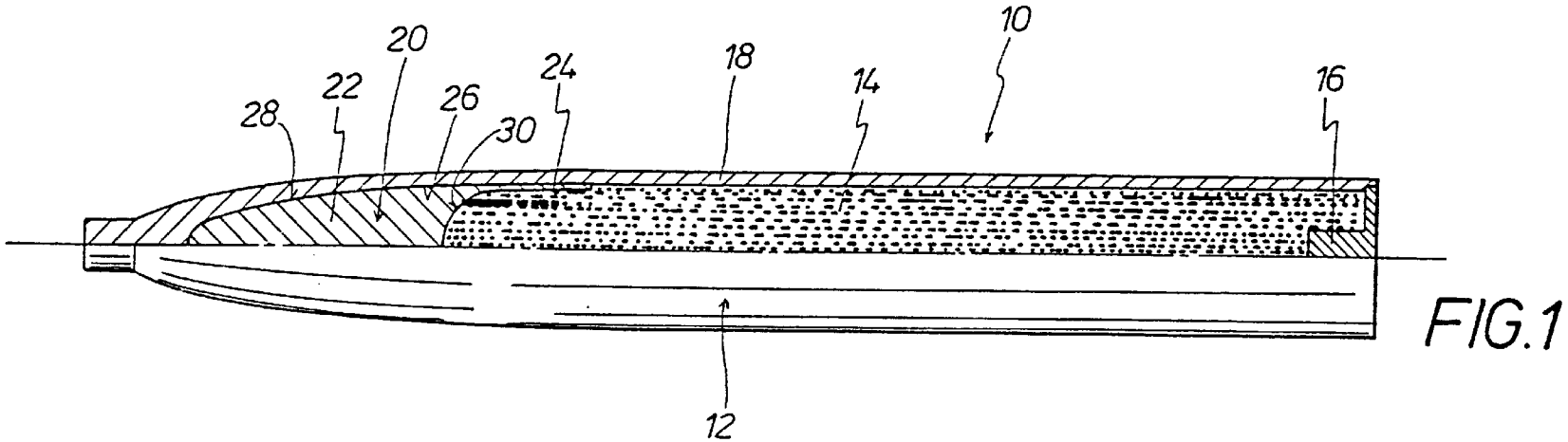
FIG. 1 illustrates a first embodiment of the penetrator.

FIG. 1 illustrates a penetrator 10 possessing a penetrator housing 12, and in which there is arranged an explosive charge 14. An ignition or fuze system 16 serves for the triggering of the explosive charge 14.

The penetrator housing 12 consists of a steel outer housing 18 and a heavy-metal inner component 20 which are interconnected in surface contact with each other. The heavy-metal inner component 20 possesses a solid tip portion 22 to which at the rear end thereof, there is unitarily connected a thin walled sleeve portion 24. The heavy-metal inner component 20 possesses an outer contour 26 which is precisely conformed with the inner contour 28 of the steel outer housing 18.

The solid tip portion 22 of the heavy-metal inner component 20 is formed with a concave rear surface 30, which forms continuous transition into the rearwardly-located sleeve portion 24.

Figure 2:
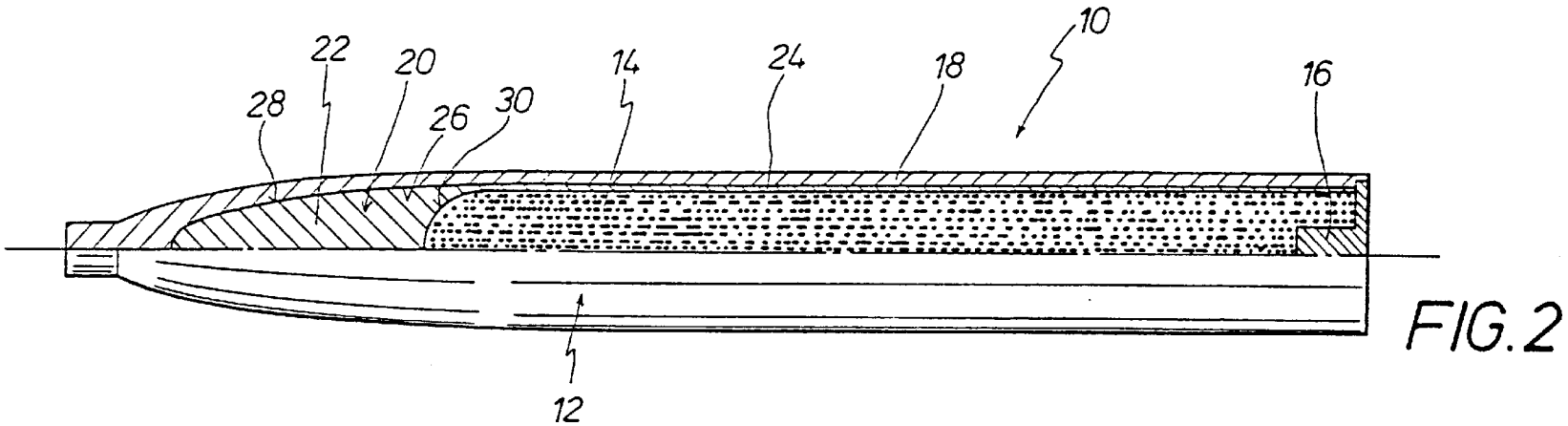
FIG. 2 illustrates a second embodiment of the penetrator in a representation which is similar to that shown in FIG. 1.

In the embodiment of the penetrator 10 pursuant to FIG. 1, the thin-walled sleeve portion 24 of the heavy-metal inner component 20 possesses a longitudinal axial extent which, in comparison with the overall length of the steel outer housing 18 and thusly with regard to the total length of the penetrator 10, is relatively short. In contrast therewith, FIG. 2 illustrates an embodiment of the penetrator 10 in which the heavy-metal inner component 20 is constructed with a thin-walled sleeve portion 24 which extends along the entire length of the steel outer housing 18 and thereby the penetrator 10.

The same details in FIG. 2 are identified by the same reference numerals with those in FIG. 1, so that it is considered to be unnecessary in connection with FIG. 2 to again describe in detail all of these individual details.

What is claimed is:

1. A penetrator having a penetrator housing (12) an explosive charge (14) and an ignition system (16) for triggering the explosive charge (14) being arranged in said housing, the penetrator housing (12) being constituted from a composite of a steel outer housing (18) having a closed nose portion and an inner component contained within said housing (20) constituted of a material selected from the group consisting of a metal containing tungsten and pure tungsten, said inner component (20) possesses a solid tip portion (22) and a hollow cylindrical sleeve portion (24) unitarily connected to a rear end of said solid tip portion (22) and extending rearwardly within said steel outer housing (18), said solid tip portion (12) and said hollow cylindrical sleeve portion (24) conform with an inner contour (28) of the steel outer housing (18), said steel outer housing (18) consisting of a steel alloy possessing properties of high-strength, hardness and ductility, the explosive charge being in direct contact with an inner surface of the inner component, the inner component (20) serving for a reduction in the mass of the steel outer housing (18) and for an increase in the volume and quantity of the explosive charge.

2. A penetrator according to claim 1, wherein the solid tip portion (22) of the inner component (20) possesses a concave rear surface (30) which forms a continual transition into the rearwardly extending sleeve portion (24).

3. A penetrator according to claim 1, wherein the sleeve portion (24) of the inner component (20) is shorter than the axial length of the steel outer housing (18) of the penetrator (10).

4. A penetrator according to claim 3, wherein the sleeve portion (24) of the inner component (20) is shorter than one-half of the axial length of the steel outer housing (18) of the penetrator (10).

5. A penetrator according to claim 1, wherein the sleeve portion (24) of the inner component (20) extends along the entire axial length of the steel outer housing (18) of the penetrator (10).

6. A penetrator according to claim 1, wherein the steel outer housing (18) and the inner component (20) are interconnected by a copper matrix through forging.

7. A penetrator according to claim 1, wherein the steel outer housing (18) and the inner component (20) are interconnected by a metallic adhesion layer through a diffusion-controlled temperature and pressure process.

8. A penetrator according to claim 7, wherein the metallic adhesion layer is constituted of a material selected from the group of materials consisting of tantalum, cobalt, cobalt-iron, nickel, nickel-iron and vanadium.

9. A penetrator according to claim 1, wherein the steel outer housing (18) and the inner component (20) are interconnected by a shrink fit.

* * * * *